US007048350B2

(12) United States Patent
Im et al.

(10) Patent No.: US 7,048,350 B2
(45) Date of Patent: May 23, 2006

(54) COLOR PRINTING METHOD AND APPARATUS FOR AN INKJET PRINTER

(75) Inventors: Dae-hyeok Im, Gyeonggi-do (KR); Kyung-cheol Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1 day.

(21) Appl. No.: 10/602,635

(22) Filed: Jun. 25, 2003

(65) Prior Publication Data

US 2004/0041856 A1 Mar. 4, 2004

(30) Foreign Application Priority Data

Sep. 2, 2002 (KR) ..... 10-2002-0052458

(51) Int. Cl.
*B41J 29/393* (2006.01)

(52) U.S. Cl. ..... 347/19; 347/15; 347/43

(58) Field of Classification Search ..... 347/15, 347/43, 19, 14, 85, 86, 24; 358/502
See application file for complete search history.

(56) References Cited

U.S. PATENT DOCUMENTS 6,196,663 B1 * 3/2001 Wetchler et al. ..... 347/43

FOREIGN PATENT DOCUMENTS

| | | |
|---|---|---|
| JP | 6-233092 | 8/1994 |
| JP | 7-285227 | 10/1995 |
| JP | 9-11507 | 1/1997 |
| JP | 2001-26116 | 1/2001 |

OTHER PUBLICATIONS

Chinese Office Action Issued on Apr. 8, 2005.

* cited by examiner

*Primary Examiner*—Lamson Nguyen
(74) *Attorney, Agent, or Firm*—Staas & Halsey LLP

(57) ABSTRACT

A color printing method and apparatus include a printer printing a color image on a recording paper using color inks contained in a color cartridge includes detecting a residual amount of each of the color inks. The residual amount of each of the color inks is compared with a predetermined standard residual amount. The color image is printed using the at least one of the color inks having the residual amount greater than the predetermined standard residual amount.

20 Claims, 4 Drawing Sheets

COLOR PRINTING METHOD AND APPARATUS FOR AN INKJET PRINTER

CROSS-REFERENCE TO RELATED APPLICATIONS

This application claims the benefit of Korean Application No. 2002-52458, filed Sep. 2, 2002, in the Korean Intellectual Property Office, the disclosure of which is incorporated herein by reference.

BACKGROUND OF THE INVENTION

1. Field of the Invention

The present invention relates to a color printing method for an inkjet printer, and more particularly, to a color printing method for an inkjet printer by which ink is saved to print a color image.

2. Description of the Related Art

Inkjet printers generally discharge ink droplets from an ink cartridge on a recording piece of paper to form an image. The ink cartridge is mounted in a carriage moving in a perpendicular direction to a feeding direction of the recording piece of paper. In particular, in color inkjet printers for printing a color image, a mono cartridge containing black ink and a color cartridge containing a plurality of color inks other than black, e.g., cyan, magenta, and yellow inks, are mounted in the carriage. Thus, the color image is formed by mixing the inks in both cartridges.

FIG. 1 schematically shows a conventional color cartridge. Referring to FIG. 1, a color cartridge 10 includes a housing 12, which has a predetermined internal space, and a recording head 18, which is installed underneath a bottom of the housing 12 and discharges ink droplets on the recording piece of paper. The internal space of the housing 12 is partitioned into three ink chambers 16*a*, 16*b*, and 16*c* by two partitions 14 that are perpendicularly installed inside the housing 12. The ink chambers 16*a*, 16*b*, and 16*c* contain cyan, magenta, and yellow color inks 17*a*, 17*b*, and 17*c*, respectively. The cyan, magenta, and yellow color inks 17*a*, 17*b*, and 17*c* are supplied to the recording head 18 via ink paths 19*a*, 19*b*, and 19*c* formed in bottom partitions of the ink chambers 16*a*, 16*b*, and 16*c*, and then discharged from the recording head 18 onto the recording piece of paper in the form of droplets.

As shown in FIG. 1, one color cartridge 10 generally contains the three color inks 17*a*, 17*b*, and 17*c*. However, amounts of the color inks 17*a*, 17*b*, and 17*c* that are used to print the color image different according to a color configuration of the color image. Thus, any one of the three color inks 17*a*, 17*b*, and 17*c* may be first exhausted, and then the two remaining color inks may be sequentially exhausted. If one particular type of color ink is exhausted, the color image having the color exhausted cannot be printed. In this case, in conventional color cartridges, a warning message informing a user of the exhaustion of the particular color ink is displayed. If the user neglects the warning message and continues a printing process, the color printer uses only the remaining color inks. For example, if the yellow color ink 17*c* is exhausted, the color printer only uses the cyan and magenta color inks 17*a* and 17*b*. Thus, a yellow color portion of the image is not printed. If the yellow and magenta color inks 17*c* and 17*b* are exhausted, the color printer only uses the cyan color ink 17*a*. Thus, yellow and magenta color portions of the image are not printed.

As described above, in the conventional color cartridges, if one or two color inks of the three color inks contained in the color cartridge are exhausted, the color image having the color exhausted cannot be obtained, i.e., the color image having the same quality as the color image printed using all of the tree color inks cannot be obtained. In this case, although some of the color inks are not completely exhausted, the color cartridge has to be replaced with a new one in order to print the color image including all the image colors. In other words, in a conventional inkjet printer, if one color ink is exhausted, an exiting color cartridge has to be replaced with a new one. Thus, a period for replacing the color cartridge is relatively short. In addition, the remaining color inks cannot be used any more.

SUMMARY OF THE INVENTION

Additional aspects and/or advantages of the invention will be set forth in part in the description which follows and, in part, will be obvious from the description, or may be learned by practice of the invention.

Accordingly, an aspect of the present invention provides a color printing method for an inkjet printer by which a color ink, a large amount of which has been consumed, can be saved by providing an opportunity for a user to select a plurality of printing modes when the amount of one or more color inks is smaller than the standard residual amount.

According to an aspect of the present invention, there is provided a color printing method of an inkjet printer printing a color image on a recording paper using color inks contained in a color cartridge. The color printing method includes: detecting a residual amount of each of the color inks; comparing the residual amount of each of the color inks with a predetermined standard residual amount and determining whether the residual amount of at least one color ink is less than the predetermined standard residual amount; if the residual amount of the at least one color ink is less than the predetermined standard residual amount, selecting one of a normal printing mode in which the color image is printed using all of the color inks and an ink saving printing mode in which the color image is printed using at least one of the color inks having residual amount greater than the predetermined standard residual amount; and printing the color image according to the selected printing mode.

The selection of the printing mode may include: displaying a printing mode selection window including the normal printing mode, a mono color printing mode in which the color image is printed using only one of the color inks having the residual amount greater than the predetermined standard residual amount, and a two color printing mode in which the color image is printed using two color inks of the color inks having the residual amounts greater than the predetermined standard residual amount; selecting one of the normal printing mode, the mono color printing mode, and the two color printing mode; and printing the color image according the selected printing mode.

The selection of the printing mode may include: displaying a printing mode selection window including the normal printing mode and the ink saving printing mode; selecting one of the normal printing mode and the ink saving printing mode; determining whether the selected printing mode is the ink saving printing mode; if the selected printing mode is the ink saving printing mode, displaying a type selection window of the ink saving printing mode having a mono color printing mode in which an image is printed using only one of the color inks having the residual amount greater than the predetermined standard residual amount, and a two color printing mode in which the color image is printed using two color inks of the color inks having the residual amount greater than the predetermined standard residual amount; selecting one of the mono color printing mode and the two color printing mode; and printing an image according to printing modes selected.

According to an aspect of the present invention, the method further includes displaying the residual amount of each of the plurality of color inks.

In the selection of the printing mode, the residual amount of each of the color inks is displayed.

According to an aspect of the present invention, in the selection of the printing mode, a warning message is displayed when the residual amount of the at least one color ink is less than the predetermined standard residual amount.

According to an aspect of the present invention, the mono color printing mode is a printing mode in which the color image having color tones corresponding to all of the plurality of color inks is printed using one selected color ink.

According to an aspect of the present invention, the two color printing mode is a printing mode in which the color image having color tones corresponding to two selected color inks is printed.

According to an aspect of the present invention, there is provided a color printing method of a printer printing a color image on a recording paper using color inks contained in a color cartridge, the color printing method including: detecting a residual amount of each of the color inks; comparing the residual amount of each of the color inks with a predetermined standard residual amount; determining whether the residual amount of at least one of the color inks is less than the predetermined standard residual amount; printing the image using all of color inks when the residual amount of each of the color inks is greater than the predetermined standard residual amount; and transmitting a warning message when the residual amount of at least one of the color inks is less than the predetermined standard residual amount.

According to an aspect of the present invention, there is provided a color printing method of a printer printing a color image on a recording paper using color inks contained in a color cartridge, the color printing method including: detecting a residual amount of each of the color inks; comparing the detected residual amount of each of the color inks with a predetermined standard residual amount; displaying a printing mode selection window when the residual amount of at least one of the color inks is less than the predetermined standard residual amount; selecting one of a normal printing mode and an ink saving printing mode via the printing mode selection window, wherein the normal printing mode is selected when the residual amount of each of the color inks is greater than the predetermined standard residual amount and the ink saving printing mode is selected when the residual amount of at least one of the color inks is less than the predetermined standard residual amount; printing the color image on the recording paper using all of the color inks when the normal printing mode is selected; and printing the color image on the recording paper using the color inks having residual amounts greater than the predetermined standard residual amount when the ink saving printing mode is selected.

BRIEF DESCRIPTION OF THE DRAWINGS

These and/or other aspects and/or advantages of the invention will become apparent and more readily appreciated from the following description of the aspects of the present invention, taken in conjunction with the accompanying drawings of which.

DETAILED DESCRIPTION OF THE INVENTION

Figure 1:
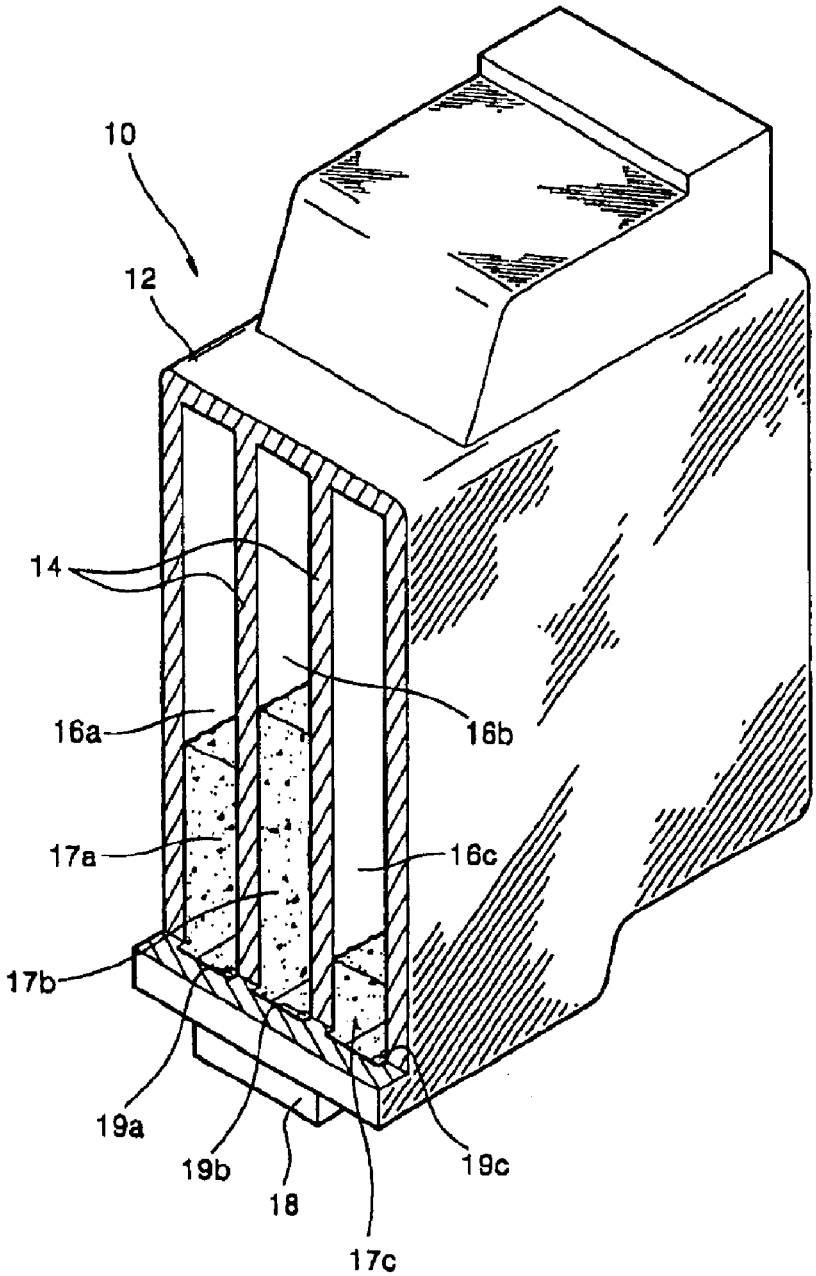
FIG. 1 (PRIOR ART)
FIG. 1 is a schematic perspective view of a conventional color cartridge.

Reference will now be made in detail to the aspects of the present invention, examples of which are illustrated in the accompanying drawings, wherein like reference numerals refer to like elements throughout. The aspects are described below in order to explain the present invention by referring to the figures.

Hereinafter, a color printing method of an inkjet printer, according to an aspect of the present invention, will be described with reference to the attached drawing.

Figure 2:
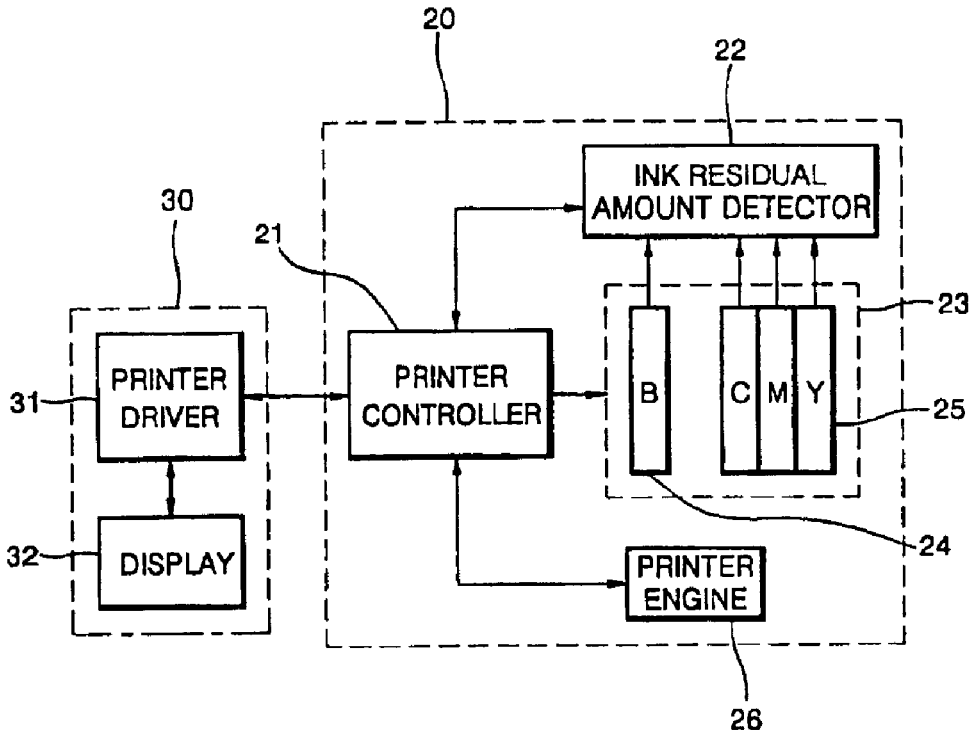
FIG. 2 is a block diagram of an inkjet printer that performs a color printing method, according to an aspect of the present invention.
Figure 3:
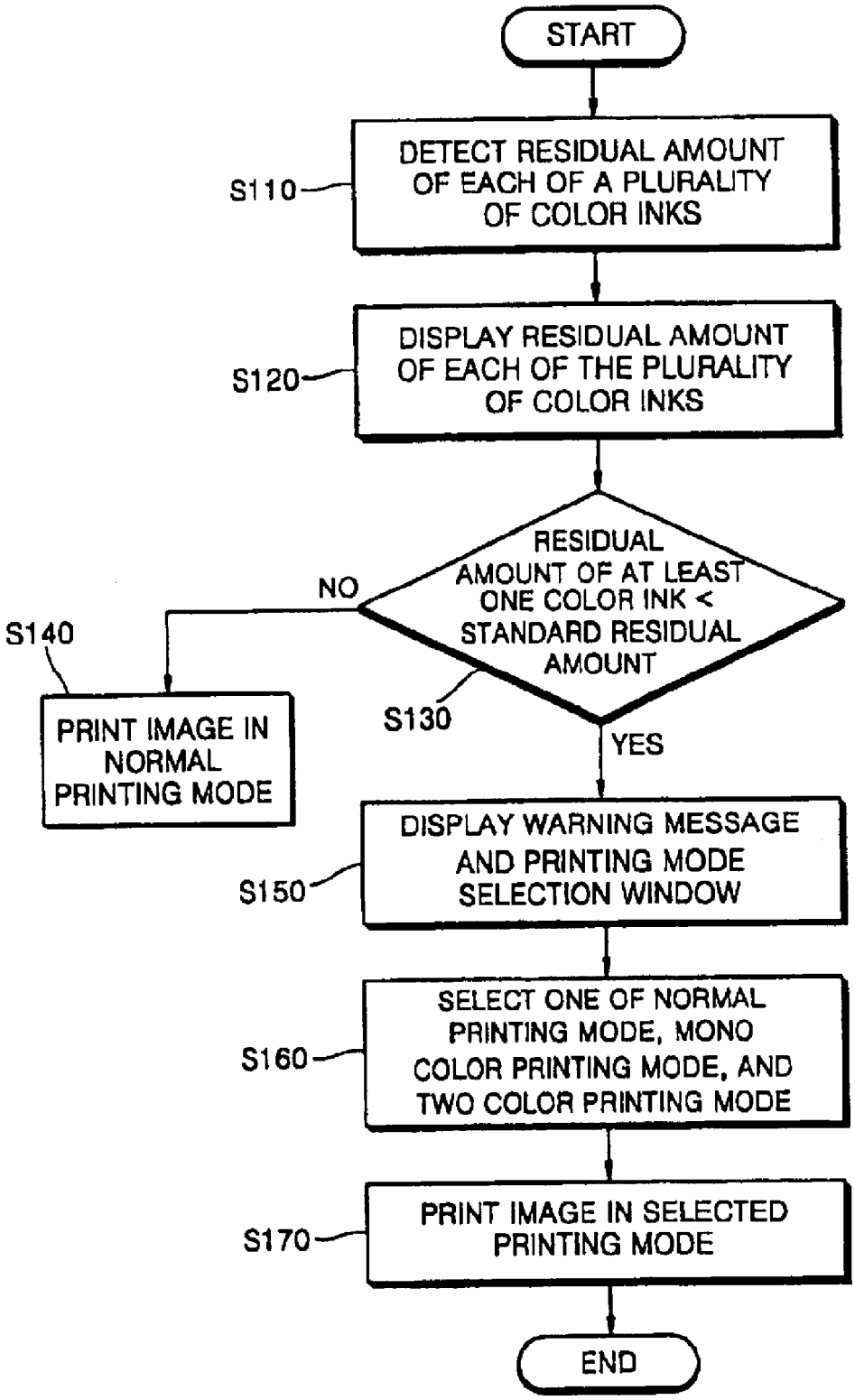
FIG. 3 is a flowchart illustrating a color printing method for the inkjet printer, according to an aspect of the present invention.

FIG. 2 is a block diagram of the inkjet printer to perform the color printing method, according to an aspect of the present invention, and FIG. 3 is a flowchart illustrating the color printing method for the inkjet printer, according to an aspect of the present invention.

Referring to FIG. 2, an inkjet printer 20 includes a printer engine 26 to print an image on a recording paper using ink supplied from an ink cartridge 23, and a printer controller 21, which controls operations of different components of the inkjet printer 20. The ink cartridge 23 includes a mono cartridge 24 containing black (B) ink and a color cartridge 25 containing a plurality of color inks, e.g., cyan (C), magenta (M), and yellow (Y) color inks. The inkjet printer 20 further includes an ink residual amount detector 22, which detects a residual amount of the black ink and a residual amount of each of the color inks.

The printer controller 21 is an interface between a printer driver 31 in a computer 30 and the inkjet printer 20. Thus, data indicative of the residual amount of each of the color inks detected by the ink residual amount detector 22 is transmitted to the printer driver 31 in the computer 30 via the printer controller 21.

The printer driver 31 displays a printing mode selection window via a display 32 so that a user can select a proper printing mode depending on the residual amount detected of each of the color inks. Thereafter, the printer driver 31 processes image data based on the printing mode selected by the user, and transmits the processed image data with a control signal to control the printer 20 to print the processed image data according to the printing mode selected by the user. Thus, the printer controller 21 controls a printer engine 26 to print the image data on the recording paper according to the selected printing mode.

The color printing method, according to an aspect of the present invention, will be described with reference to FIGS. 2 and 3.

When the printer driver 31 transmits a printing command signal to the printer controller 21, at operation S110, the printer controller 21 controls the ink residual amount detector 22 to detect the residual amount of each of the color inks. Here, the residual amount of the black ink can be also detected.

The data indicative of the residual amount of each of the color inks detected by the ink residual amount detector 22 is transmitted to the printer driver 31 via the printer controller 21. Thus, at operation S120, the printer driver 31 displays the data indicative of the residual amount of each of the color inks via the display 32. Here, the residual amount of each of the color inks can be represented by various methods, e.g., via a percent, a bar graph, or the like, so that the user can easily check the residual amount of each of the color inks. The residual amount of the black ink can be represented with the residual amount of each of the color inks according to the same method. The exhaustion of one or more color inks can be described with 'EMPTY'. Operation S120 may be performed with operation S150 of displaying a printing mode selection window.

At the printer driver 31, at operation S130, the residual amount of each of the color inks is compared with a predetermined standard residual amount to determine whether the residual amount of at least one of the color inks is less than the predetermined standard residual amount. The predetermined standard residual amount may be set within a range of 10–20% of an initial total amount of each of the color inks.

As a result of the determination, if the detected residual amount of each of the plurality of color inks is greater than the predetermined standard residual amount, the printer driver 31 transmits the data of the image having color tones corresponding to all of the color inks with a signal for instructing the printer controller 21 to print the image in a normal printing mode. Thus, at operation S140, the printer engine 26 prints the image on the recording paper using all of color inks.

At operation S150, if the residual amount of at least one of the color inks is less than the predetermined standard residual amount, the printer driver 31 displays the printing mode selection window via the display 32. Here, a message for warning that the residual amounts of one or more color inks of the color inks are smaller than the predetermined standard residual amount may also be displayed.

In the printing mode selection window, a normal printing mode is a mode in which the image is printed using all of the color inks. A mono color printing mode is a mode in which the image is printed using one color ink selected from the color inks, where the residual amount of the color ink selected is greater than the predetermined standard residual amount remains. A two color printing mode is a mode in which the image is printed using two color inks selected from the color inks, where the residual amount of the color ink selected is greater than the predetermined standard residual amount remains, which is displayed. In detail, the mono color printing mode is displayed so that one of cyan, magenta, and yellow color inks is selected. The two color printing mode is displayed so that two color inks of the cyan, magenta, and yellow color inks are selected.

For example, if the residual amount of the yellow color ink is less than the predetermined standard residual amount or is completely exhausted, four printing modes may be included in the printing mode selection window as follows.

(1) Print an image in a normal mode,
(2) Print an image using only cyan color ink.
(3) Print an image using only magenta color ink.
(4) Print an image using cyan and magenta color inks.

In another example, if the residual amounts of the yellow and magenta color inks are less than the predetermined standard residual amount or are completely exhausted, two printing modes may be included in the printing mode selection window as follows.

(1) Print an image in a normal mode.
(2) Print an image using only cyan color ink.

At operation S160, the user selects the printing mode via the displayed printing mode selection window. Here, the user can select a proper printing mode in consideration of the importance of documents to be printed and the residual amount of each of the color inks. In other words, if the importance of the document to be printed is low, the user selects the mono color printing mode or the two color printing mode, so that color ink having the relatively small residual amount can be saved for printing a next important document. However, if the importance of the document to be printed is high, the user selects the normal printing mode, so that a high quality color image can be obtained.

When one of the above described printing modes is selected, the printer driver 31 processes the image data based on the selected printing mode and transmits the processed image data with the signal to instruct the printer controller 21 to print an image based on the selected printing mode. At operation S170, the printer controller 21 controls the printer engine 26 to print the image on the recording paper in the selected printing mode.

In detail, in a case where the image is printed in the normal printing mode, the printer 20 prints the image using all of the three color inks. Thus, the printer driver 31 transmits the data of the image having color tones corresponding to all of three color inks to the printer controller 21. However, if one of three color inks is exhausted, a portion of the image corresponding to the exhausted color ink is not printed. Thus, in this case, the user has to carefully select the printing mode.

In a case where an image is printed in the mono color printing mode, the printer 20 prints image using only one selected color ink. Here, the printer 20 may print an image having color tones corresponding to all of three color inks using only the selected color ink or may print only the image having the color tone corresponding to the selected color ink. In a former case, the printer driver 31 converts the image data to image data having the color tone corresponding to the one selected color ink and transmits the converted image data to the printer controller 21. In a latter case, the printer driver 31 transmits the image data having the color tones corresponding to all of three color inks to the printer controller 21. However, in the latter case, portions of the image of the unselected color inks are not printed, and, thus, the image quality may be degraded. Thus, the former case is better than the latter case.

In an event that the image is printed in the two color printing mode, the printer 20 prints the image using the two selected color inks. Here, the print 20 may print the image having color tones corresponding to all of three color inks or may print only the image having color tones corresponding to the two selected color inks. As previously described, the printer driver 31 transmits the image data to the printer controller 21. However, because in the two color printing mode, the image is printed according to a method different from that of the mono color printing mode, the user's selection range can be widened. Also, because the color image is printed by mixing two or more color inks, even though one color ink is excluded from the mixture of the two or more color inks, the quality of the color image is not greatly degraded. Thus, in the two color printing mode, the latter case is better than the former case.

Figure 4:
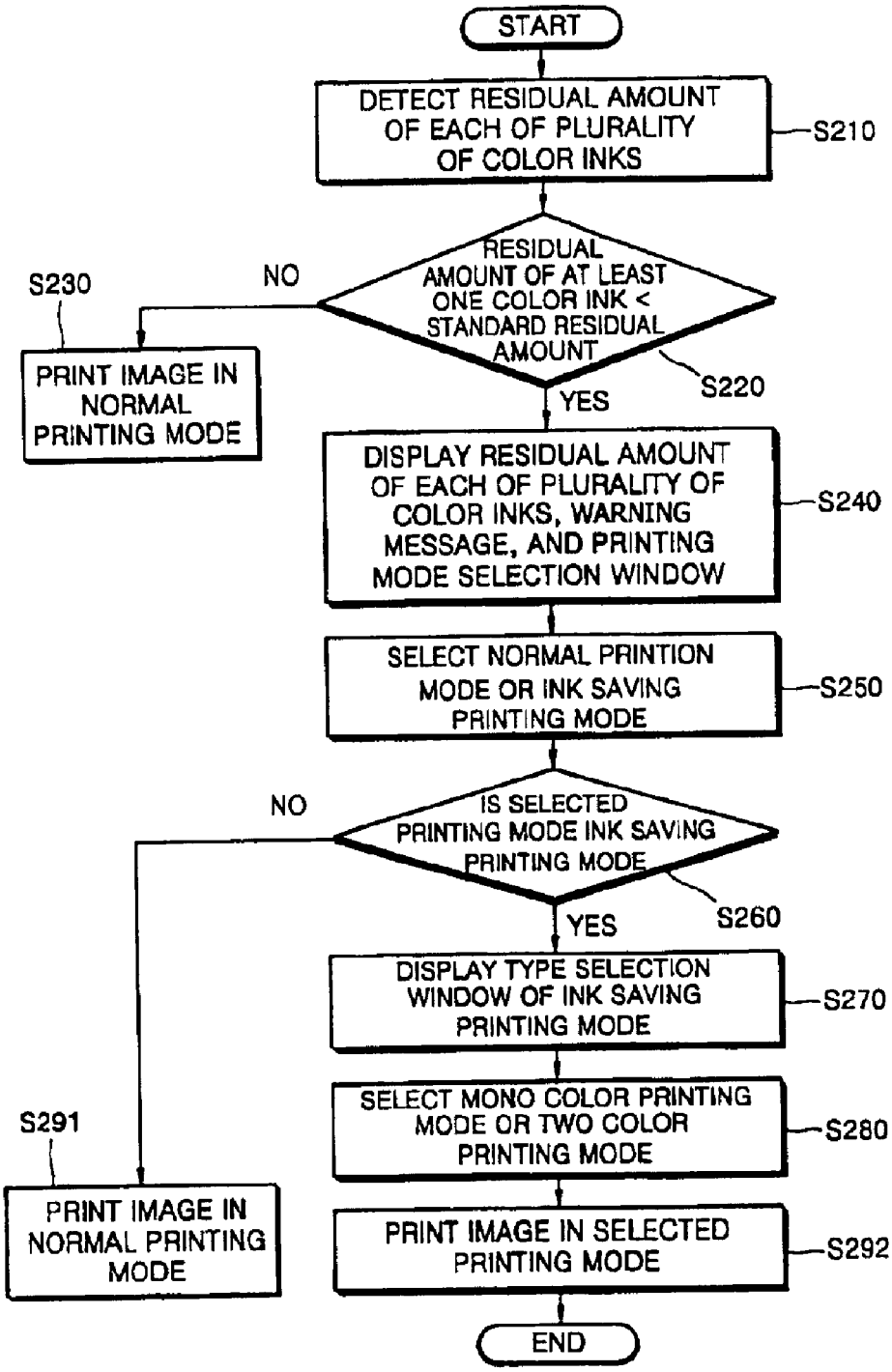
FIG. 4 is a flowchart illustrating another color printing method for the inkjet printer, according to another aspect of the present invention.

FIG. 4 is a flowchart illustrating another color printing method for the inkjet printer, according to another aspect of the present invention. Several operations of the present aspect are the same as those of the previous aspect. Thus, the same operations will not be described or will be briefly described.

Referring to FIGS. 2 and 4, at operation S210, the ink residual amount detector 22 detects the residual amount of each of the color inks according to a printing instruction signal from the printer driver 31. The detected data on the residual amount of each of the plurality of color inks is transmitted to the printer driver 31 via the printer controller 21. At the printer driver 31, at operation S220, the detected residual amount of each of the color inks is compared with the predetermined standard residual amount to determine whether the residual amount of at least one color ink is less than the predetermined standard residual amount.

As a result of the determination, at operation S230, if the residual amount of each of the color inks is greater than the predetermined standard residual amount, the printer engine 26 normally prints the image on the recording paper using all of the color inks according to the printing instruction signal from the printer driver 31.

At S240, if the residual amount of at least one of the color inks is less than the predetermined standard residual amount, the printer driver 31 displays a printing mode selection window via the display 32. Here, the printer driver 31 may also display a message warning that the residual amounts of one or more of the color inks are less than the predetermined standard residual amount. The residual amount of each of the color inks may also be displayed. As described in the previous aspect of the present invention, the residual amount of each of the plurality of color inks may be displayed after operation S210.

In the printing mode selection window, the normal printing mode in which the image is printed using all of the plurality of color inks and the ink saving printing mode in which the image is printed using at least one color ink from the color inks having amounts greater than the predetermined standard residual amount are displayed. In detail, in the present aspect of the present invention, in operation S240 of displaying the printing mode selection window, two printing modes can be included in the printing mode selection window as follows.

(1) Print an image in the normal printing mode.

(2) Print an image in the ink saving printing mode.

At operation S250, the user selects one of the normal printing mode and the ink saving printing mode via the above-described printing mode selection window. Here, as described in the previous aspect of the present invention, the user can select a proper printing mode in consideration of the importance of the document to be printed and the residual amount of each of the color inks. In other words, if the importance of the document to be printed is low, the user can select the ink saving printing mode to save the color ink, the residual amount of which is relatively small.

At operation S260, a determination is made whether the printing mode selected by the printer driver 31 is the ink saving printing mode.

As a result of determination, if the selected printing mode is the normal printing mode, the printer driver 31 transmits the signal to instruct the printer controller 21 to print the image in the normal printing mode and the data on the image containing all of the color inks. Thus, at S291, the printer engine 26 prints the image on the recording paper using all of the color inks.

If the selected printing mode is the ink saving printing mode, at operation S270, the printer driver 31 displays the type selection window of the ink saving printing mode via the display 32.

In the type selection window of the ink saving printing mode, the mono color printing mode in which the image is printed using one color ink selected from color inks having the amounts greater than the predetermined standard residual amount, and the two color printing mode in which the image is printed using two color inks selected from the color inks having the amounts greater than the predetermined standard residual amount may be displayed. In detail, the mono color printing mode is displayed so that one of cyan, magenta, and yellow color inks is selected, and the two color printing mode is displayed so that two color inks of the cyan, magenta, and yellow color inks are selected.

For example, if the residual amount of the yellow color ink is smaller than the standard residual amount or is exhausted, three printing modes can be included in the printing mode selection window as follows.

(1) Print an image using only cyan color ink.

(2) Print an image using only magenta color ink.

(3) Print an image using cyan and magenta color inks.

In another example, if the residual amounts of the yellow and magenta color inks are smaller than the standard residual amount or are completely exhausted, the printing mode selection window can be displayed as follows.

(1) Print an image using only cyan color ink.

At operation S280, the user selects the ink saving printing mode via the above-mentioned printing mode selection windows. Here, the user can select a proper printing mode in consideration of the printing methods of various printing modes that will be described below.

If the ink saving printing mode is selected, the printer driver 31 processes image data according to the selected printing mode and transmits the processed data with the control signal to instruct the printer controller 21 to print the processed data according to the selected printing mode. At operation S292, the printer controller 21 controls the printer engine 26 to print the image on the recording paper in the selected printing mode.

In detail, if the image is printed in the mono color printing mode, the printer 20 prints the image using only one selected color ink. Here, as described above, in accordance with an aspect of the present invention, the image having color tones corresponding to all of the color inks is printed. If the image is printed in a two color printing mode, the printer 20 prints the image using two selected color inks. Here, as described, according to an aspect of the present invention, only the image having color tones corresponding to the two selected color inks is printed.

As described above, in a color printing method for an inkjet printer according to an aspect of the present invention, when a residual amount of one color ink is less than a standard residual amount or is completely exhausted, a user selects only color inks having a residual amount greater than the standard residual amount to print the color image. Thus, the color inks may be saved because a color image can be printed using all of the color inks when necessary, a high quality image can be obtained.

Also, because color inks having amounts less than the standard residual amount are not used, the consumption of each of the color inks can be uniformly controlled. Thus, at times when the color inks are exhausted are similar, and thus, a period increases for replacing an existing color cartridge with a new one.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A color printing method of an inkjet printer printing a color image on a recording paper using color inks contained in a color cartridge, the color printing method comprising:

detecting a residual amount of each of the color inks;

comparing the residual amount of each of the color inks with a predetermined standard residual amount and determining whether the residual amount of at least one color ink is less than the predetermined standard residual amount;

if the residual amount of the at least one color ink is less than the predetermined standard residual amount, selecting between a normal printing mode in which the color image is printed using all of the color inks and an ink saving printing mode in which the color image is printed using at least one of the color inks having residual amount greater than the predetermined standard residual amount; and printing the color image according to the selected printing mode.

2. The color printing method of claim 1, wherein in the selection of the printing mode, a warning message is displayed when the residual amount of the at least one color ink is less than the predetermined standard residual amount.

3. A color printing method of an inkjet printer printing a color image on a recording paper using color inks contained in a color cartridge, the color printing method comprising:

detecting a residual amount of each of the color inks;

comparing the residual amount of each of the color inks with a predetermined standard residual amount and determining whether the residual amount of at least one color ink is less than the predetermined standard residual amount;

if the residual amount of the at least one color ink is less than the predetermined standard residual amount, selecting one of a normal printing mode in which the color image is printed using all of the color inks and an ink saving printing mode in which the color image is printed using at least one of the color inks having residual amount greater than the predetermined standard residual amount; and printing the color image according to the selected printing mode, wherein the selection of the printing mode comprises:

displaying a printing mode selection window comprising the normal printing mode, a mono color printing mode in which the color image is printed using only one of the color inks having the residual amount greater than the predetermined standard residual amount, and a two color printing mode in which the color image is printed using two color inks of the color inks having the residual amounts greater than the predetermined standard residual amount;

selecting one of the normal printing mode, the mono color printing mode, and the two color printing mode; and printing the color image according the selected printing mode.

4. The color printing method of claim 3, wherein the mono color printing mode is a printing mode in which the color image having color tones corresponding to all of the plurality of color inks is printed using one selected color ink.

5. A The color printing method of claim 3, wherein the mono color printing mode is a printing mode in which the color image having a color tone corresponding to one selected color ink is printed.

6. The color printing method of claim 3, wherein the two color printing mode is a printing mode in which the color image having color tones corresponding to two selected color inks is printed.

7. The color printing method of claim 3, wherein the two color printing mode is a printing mode in which the color image having color tones corresponding to all of the color inks is printed using two selected color inks.

8. A color printing method of an inkjet printer printing a color image on a recording paper using color inks contained in a color cartridge, the color printing method comprising:

detecting a residual amount of each of the color inks;

comparing the residual amount of each of the color inks with a predetermined standard residual amount and determining whether the residual amount of at least one color ink is less than the predetermined standard residual amount;

if the residual amount of the at least one color ink is less than the predetermined standard residual amount, selecting one of a normal printing mode in which the color image is printed using all of the color inks and an ink saving printing mode in which the color image is printed using at least one of the color inks having residual amount greater than the predetermined standard residual amount; and printing the color image according to the selected printing mode, wherein the selection of the printing mode comprises:

displaying a printing mode selection window comprising the normal printing mode and the ink saving printing mode;

selecting one of the normal printing mode and the ink saving printing mode;

determining whether the selected printing mode is the ink saving printing mode;

if the selected printing mode is the ink saving printing mode, displaying a type selection window of the ink saving printing mode having a mono color printing mode in which an image is printed using only one of the color inks having the residual amount greater than the predetermined standard residual amount, and a two color printing mode in which the color image is printed using two color inks of the color inks having the residual amount greater than the predetermined standard residual amount;

selecting one of the mono color printing mode and the two color printing mode; and printing an image according to printing modes selected.

9. The color printing method of claim 8, wherein the mono color printing mode is a printing mode in which the color image having color tones corresponding to all of the color inks is printed using one selected color ink.

10. The color printing method of claim 8, wherein the mono color printing mode is a printing mode in which only the color image having a color tone corresponding to one selected color ink is printed.

11. The color printing method of claim 8, wherein the two color printing mode is a printing mode in which only the color image having color tones corresponding to two selected color inks are printed.

12. The color printing method of claim 8, wherein the two color printing mode is a printing mode in which the color image having color tones corresponding to all of the color inks is printed using two selected color inks.

13. A color printing method of an inkjet printer printing a color image on a recording paper using color inks contained in a color cartridge, the color printing method comprising:

detecting a residual amount of each of the color inks;

comparing the residual amount of each of the color inks with a predetermined standard residual amount and determining whether the residual amount of at least one color ink is less than the predetermined standard residual amount;

if the residual amount of the at least one color ink is less than the predetermined standard residual amount, selecting one of a normal printing mode in which the color image is printed using all of the color inks and an ink saving printing mode in which the color image is printed using at least one of the color inks having residual amount greater than the predetermined standard residual amount;

printing the color image according to the selected printing mode; and displaying the residual amount of each of the plurality of color inks.

14. A color printing method of an inkjet printer printing a color image on a recording paper using color inks contained in a color cartridge, the color printing method comprising:

detecting a residual amount of each of the color inks;

comparing the residual amount of each of the color inks with a predetermined standard residual amount and determining whether the residual amount of at least one color ink is less than the predetermined standard residual amount;

if the residual amount of the at least one color ink is less than the predetermined standard residual amount, selecting one of a normal printing mode in which the color image is printed using all of the color inks and an ink saving printing mode in which the color image is printed using at least one of the color inks having residual amount greater than the predetermined standard residual amount; and printing the color image according to the selected printing mode, wherein in the selection of the printing mode, the residual amount of each of the color inks is displayed.

15. A color printing method of a printer printing a color image on a recording paper using color inks contained in a color cartridge, the color printing method comprising:

detecting a residual amount of each of the color inks;

comparing the residual amount of each of the color inks with a predetermined standard residual amount;

determining whether the residual amount of at least one of the color inks is less than the predetermined standard residual amount;

printing the image using all of color inks when the residual amount of each of the color inks is greater than the predetermined standard residual amount;

transmitting a warning message when the residual amount of at least one of the color inks is less than the predetermined standard residual amount; and selecting between a normal printing mode and a plurality of ink saving printing modes based on the determining whether the residual amount is less than the predetermined standard residual amount.

16. The color printing method of claim 15, wherein the selecting comprises selecting according to an importance of the color image to be printed, the method further comprising printing the color image corresponding to the printing mode selected, wherein the normal printing mode is a mode in which the color image is printed using the black ink and all of the color inks, where the residual amount of the black ink and all of the color inks is greater than the predetermined standard residual amount, and the ink saving printing modes comprises:

a mono color printing mode where the color image is printed using one color ink selected from the color inks, where the residual amount of the color ink selected is greater than the predetermined standard residual amount, and a two color printing mode where the color image is printed using two color inks selected from the color inks, where the residual amount of the color inks selected is greater than the predetermined standard residual amount.

17. A color printing method of a printer printing a color image on a recording paper using color inks contained in a color cartridge, the color printing method comprising:

detecting a residual amount of each of the color inks;

comparing the residual amount of each of the color inks with a predetermined standard residual amount;

determining whether the residual amount of at least one of the color inks is less than the predetermined standard residual amount;

printing the image using all of color inks when the residual amount of each of the color inks is greater than the predetermined standard residual amount; and transmitting a warning message when the residual amount of at least one of the color inks is less than the predetermined standard residual amount, wherein the residual amount of each of the color inks is displayed using at least one of a percent and a bar graph.

18. A color printing method of a printer printing a color image on a recording paper using color inks contained in a color cartridge, the color printing method comprising:

detecting a residual amount of each of the color inks;

comparing the residual amount of each of the color inks with a predetermined standard residual amount;

determining whether the residual amount of at least one of the color inks is less than the predetermined standard residual amount;

printing the image using all of color inks when the residual amount of each of the color inks is greater than the predetermined standard residual amount; and transmitting a warning message when the residual amount of at least one of the color inks is less than the predetermined standard residual amount, wherein the predetermined standard residual amount is within a range of 10–20% of an initial total amount of each of the color inks.

19. A color printing method of a printer printing a color image on a recording paper using color inks contained in a color cartridge, the color printing method comprising:

detecting a residual amount of each of the color inks;

comparing the detected residual amount of each of the color inks with a predetermined standard residual amount;

displaying a printing mode selection window when the residual amount of at least one of the color inks is less than the predetermined standard residual amount;

selecting one between a normal printing mode and an ink saving printing mode via the printing mode selection window, wherein the normal printing mode is selected when the residual amount of each of the color inks is greater than the predetermined standard residual amount and the ink saving printing mode is selected when the residual amount of at least one of the color inks is less than the predetermined standard residual amount;

printing the color image on the recording paper using all of the color inks when the normal printing mode is selected; and printing the color image on the recording paper using the color inks having residual amounts greater than the predetermined standard residual amount when the ink saving printing mode is selected.

20. A color printing method of a printer printing a color image on a recording paper using color inks contained in a color cartridge, the color printing method comprising:

detecting a residual amount of each of the color inks;

comparing the detected residual amount of each of the color inks with a predetermined standard residual amount;

displaying a printing mode selection window when the residual amount of at least one of the color inks is less than the predetermined standard residual amount; and selecting one of a normal printing mode and an ink saving printing mode via the printing mode selection window, wherein the normal printing mode is selected when the residual amount of each of the color inks is greater than the predetermined standard residual amount and the ink saving printing mode is selected when the residual amount of at least one of the color inks is less than the predetermined standard residual amount;

printing the color image on the recording paper using all of the color inks when the normal printing mode is selected;

printing the color image on the recording paper using the color inks having residual amounts greater than the predetermined standard residual amount when the ink saving printing mode is selected;

displaying a message warning that the residual amount of the at least one of the color inks is less than the predetermined standard residual amount; and displaying the residual amount of each of the color inks.

* * * * *

UNITED STATES PATENT AND TRADEMARK OFFICE

CERTIFICATE OF CORRECTION

PATENT NO. : 7,048,350 B2
APPLICATION NO. : 10/602635
DATED : May 23, 2006
INVENTOR(S) : Dae-hyeok Im et al.

It is certified that error appears in the above-identified patent and that said Letters Patent is hereby corrected as shown below:

Column 11, Line 59, after “comprising” insert --:--.

Column 12, Line 2, change “comprises:” to --comprise:--.

Signed and Sealed this

Twenty-eighth Day of November, 2006

JON W. DUDAS
*Director of the United States Patent and Trademark Office*